United States Patent [19]

Billard et al.

[11] Patent Number: 4,549,489

[45] Date of Patent: Oct. 29, 1985

[54] CARTRIDGE FOR LAUNCHING ELECTROMAGNETIC DECOYS WITH MULTIPLE CHARGES

[75] Inventors: Alain Billard, Muret; Hubert Calmettes, Villeneuve Tolosane; André Santalucia, Muret, all of France

[73] Assignee: Societe E. Lacroix - Tous Artifices, Muret, France

[21] Appl. No.: 465,284

[22] Filed: Feb. 9, 1983

[30] Foreign Application Priority Data

Feb. 17, 1982 [FR] France ..... 82 02575

[51] Int. Cl.[4] ..... F42B 13/00

[52] U.S. Cl. ..... 102/505; 343/18 B; 102/357

[58] Field of Search ..... 102/338, 340, 342, 345, 102/351, 357, 358, 478, 505, 347, 334, 364; 343/18 R, 18 B

[56] References Cited

U.S. PATENT DOCUMENTS

| | | | |
|---|---|---|---|
| 1,771,453 | 7/1930 | Wiley | 102/364 |
| 2,459,687 | 1/1949 | Decker | 102/345 |
| 2,476,302 | 7/1949 | Jeppson | 102/351 |
| 3,718,070 | 2/1973 | Schneider, Jr. . | |
| 3,808,940 | 5/1974 | Schilreff . | |
| 3,841,219 | 10/1974 | Schilreff . | |
| 3,899,975 | 8/1975 | Lawrence | 102/505 |
| 4,129,078 | 12/1978 | Schneider, Jr. et al. | 102/505 |
| 4,222,306 | 9/1980 | Maury | 102/342 X |

FOREIGN PATENT DOCUMENTS

| | | | |
|---|---|---|---|
| 2215404 | 8/1974 | France . | |
| 2436363 | 9/1978 | France . | |
| 218665 | 12/1941 | Switzerland . | |
| 1534134 | 11/1978 | United Kingdom | 102/357 |

*Primary Examiner*—Harold J. Tudor

*Attorney, Agent, or Firm*—McCormick, Paulding & Huber

[57] ABSTRACT

A cartridge for launching electromagnetic decoys with multiple charges comprises an elongated tube having an open upper end and a closed lower end, in which a plurality of flat holders, containing electromagnetic decoys are stacked over the length of the tube. At least one of the upper and lower surfaces of each flat holder is a conical surface in the shape of a flattened cone and each flat holder is provided in its lower part with a pyrotechnic charge able to project it upwards and to disperse the decoys. Each charge is connected to an adjacent charge by a pyrotechnic retarder and the upper most charge of the stack is provided with at least one pyrotechnic initiator, such that the arrangement formed by the initiator, the chargers and the retarders forms a continuous pyrotechnic chain, in order to allow, after detonation of the initiator, the successive ejection of the flat holders in a predetermined timed sequence.

10 Claims, 2 Drawing Figures

CARTRIDGE FOR LAUNCHING ELECTROMAGNETIC DECOYS WITH MULTIPLE CHARGES

Figure 1:
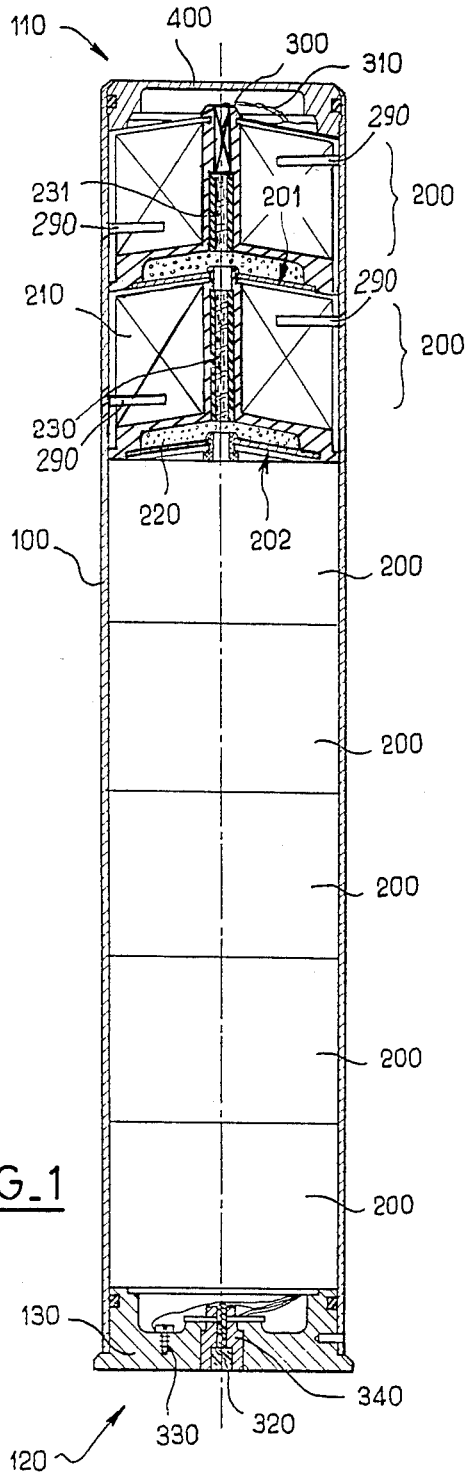

The present invention relates to a cartridge for launching electromagnetic decoys.

Ammunition of this type is intended to scatter a cloud of decoys in the atmosphere, i.e. a cloud of fine metal or metallized flakes forming a reflective screen for electromagnetic waves such as radar waves, for the purpose of jamming or on the contrary as marking means.

It is certain that the reflective screen effect is linked with the quality of dispersion of the flakes in the atmosphere. Numerous shapes of envelope have been proposed in order to improve this factor, as well as partitioning of the load of decoys in order to improve their spatial distribution upon the explosion of the dispersing charge.

It may be desirable to effect the dispersion of the decoys in stages over a period of time, which makes it possible to obtain a very good distribution in space, which could not have been obtained with known ammunition comprising a single dispersing charge, unless it was by launching a large number of the latter.

The invention proposes ammunition of this type: not only is the load of decoys divided in the latter, but each individual load of decoys has its own pyrotechnic dispersing charge, the various charges of the cartridge advantageously being connected to each other by pyrotechnic retarders; the pyrotechnic chain formed by the dispersing charges and the alternate retarders forms a continuous pyrotechnic chain, which may be detonated by an initiating charge located at the end of the chain.

After detonating the initiator, this arrangement facilitates the successive ejection of the flat holders in a predetermined timed sequence. By a suitable choice of the length of the delays in this sequence, in particular it is possible to produce a cloud of decoys whereof the dynamic evolution is able to simulate the movement of an aircraft and in particular to create confusion with the aircraft launching the ammunition. For this, the ejection of the decoys must be controlled perfectly, both in time and in space.

For this, the invention proposes a cartridge comprising: an elongated tube with an open upper end and a closed lower end; a plurality of individual flat holders, containing the electromagnetic decoys, stacked over the length of the tube; at least one of the upper and lower surfaces of each flat holder being a conical surface in the shape of a flattened cone; each flat holder being provided in its lower part with a pyrotechnic charge able to project it in the direction of the open end and to proceed with the dispersion of the decoys; each charge being connected to the adjacent charge by a pyrotechnic retarder; the upper charge of the stack being provided with at least one pyrotechnic initiator, the arrangement formed by the initiator, the charges and the retarders forming a continuous pyrotechnic chain.

Preferably, the flattened cone forming the upper or lower surface of each flat holder has its apex directed towards the upper end of the cartridge.

Also preferably, each of the upper and lower surfaces of each flat holder is a conical surface in the shape of a flattened cone, the two corresponding cones having the same half-angle at the apex, the value of the latter advantageously being comprised between 80° and 85°.

At the moment of ejection of the flat holder, the presence of conical surfaces ensures a better ejection and dispersion of the decoys than when they are stacked in the form of a cylindrical load defined by two parallel planes. Furthermore, the dispersion diagram which they produce is much closer to optimum operational conditions, thus improving the decoy effect of the ammunition.

Moreover, it is advantageous to provide, on all or part of the flat holders, one or more transverse cuts making it possible, in manner known per se, to widen the spectrum of frequencies for which the cloud behaves as a decoy.

By combining this feature with the structure of the invention, it becomes possible, by transverse cuts, to transform a population of flakes of homogeneous length into a population of flakes whereof the lengths are distributed according to a histogram wisely chosen depending on the frequency band (or bands) to be covered, preferably comprised between 5 and 40 GHz.

The arrangement and thus its contents, preferably has a symmetry of revolution with respect to the axis of the tube.

For each flat holder of the ammunition, the cuts provided in this way make it possible to have at ones disposal a load of decoys covering a wide band of frequencies and for which the most interesting bands on the operational plane are strengthened on account of the choice of histogram of the lengths of flakes.

In a preferred embodiment, each flat holder comprises: an individual envelope containing the decoys, the outer section of which is substantially equal to the inner section of the tube, which is closed on its upper face, with the exception of an orifice allowing the transmission of fire; a disc for closing the lower face, provided with a hollow axial extension, opening out in the direction of the orifice in the upper face of the envelope and containing the retarder, the disc also being provided with an open cavity able to receive the charge for the flat holder and a closure member for this cavity comprising an orifice allowing the transmission of fire.

The lengths of the delays are advantageously comprised between 0.05 and 0.4 seconds.

Figure 2:
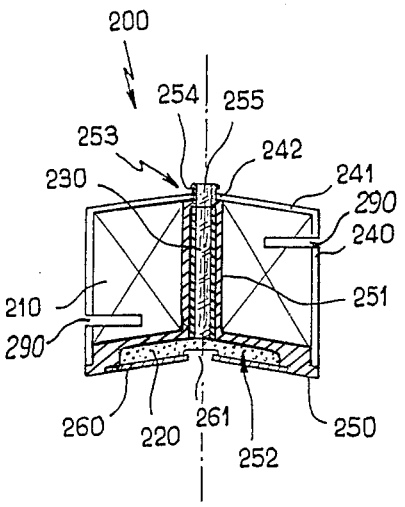

Further features and advantages of the cartridge according to the invention will become more apparent on reading the ensuing detailed description, given with reference to the accompanying figures, in which:

FIG. 1 is a longitudinal section of the cartridge according to the invention, FIG. 2 shows the detail of one of the flat holders contained in this cartridge.

The cartridge is first of all constituted by an elongated tube 100, which is preferably cylindrical and whereof the upper end 110 is open and the lower end 120 is closed.

It is obvious that the terms "upper" and "lower" have only a relative value and relate to the presentation of the accompanying drawings. These terms should in no way prejudice a particular orientation of the cartridge at the time of its manufacture, firing, dispersion of the decoys etc.

Stacked inside the tube 100 are a plurality of flat holders 200 containing decoys 210. These flat holders may be identical, but they are not necessarily so, for example if one wishes to fill the same cartridge with decoys of different lengths.

It is also possible, that inside each of the flat holders, to arrange decoys of different lengths, if one takes care to provide transverse cuts 290, in particular after having packed the flat holders between two faces in the shape of a flattened cone (conical surfaces 201 and 202).

Each flat holder is provided with a pyrotechnic dispersing charge 220 making it possible to project the decoys from the cartridge and scatter them in the atmosphere. Each of these charges is connected to the preceding (upper) charge by the intermediary of a pyrotechnic retarder 230, thus forming a continuous pyrotechnic chain. The first charge of this chain (the upper charge) is possibly detonated by the intermediary of an additional pyrotechnic retarder 231 itself ignited by a pyrotechnic initiator 300.

Preferably, the priming of this initiator 300 is carried out electrically, through the intermediary of flat wires 310 enclosed in the tube and opening out, at the other end 120 of the latter, at terminals 320 and 330. These terminals may be coaxial for example, one of the terminals, for example the terminal 330, being constituted by the metal mass formed by the bush 130 closing off the lower end of the tube. A sleeve 340 ensures electrical insulation.

Finally, the upper open end 110 is closed off by a removable protective cover 400. This cover can be ejected under the effect of the explosion of the first charge of the pyrotechnic chain.

FIG. 2 shows one of the flat holders 200 located inside the tube 100, in detail.

This flat holder comprises an individual envelope 240 containing the decoys 210. The outer section of this envelope is substantially equal to the inner section of the tube 100, in order to allow easy stacking of the flat holders at the time of assembly of the various parts of the cartridge. The upper face 241 of the envelope is closed, with the exception of an orifice 242 allowing the transmission of fire coming from the charge of the preceding flat holder, this transmission of fire allowing the ignition of the retarder 230.

The lower face of the individual envelope is closed by a disc 250, provided with an axial extension 251 containing the retarder 230. This closure disc 250 is also provided with a cavity 252 open on the under side and containing the pyrotechnic dispersing charge 220. This cavity is itself finally closed by a closure member 260, provided in its centre with an orifice 271 allowing the transmission of fire towards the following (lower) flat holder.

At the upper end, the axial extension comprises an emergent part 253 passing through the orifice 242 of the individual envelope. This emerging part is provided with a circular groove 254 allowing its engagement on the orifice 261 of the closure member of the preceding (upper) flat holder. This engagement allows fixing of the stack of flat holders after assembly. An air space 255 separates the retarder from the preceding dispersing charge.

We claim:

1. A cartridge for launching electromagnetic decoys comprising an elongated tube having an open upper end and a closed lower end, a plurality of flat holders containing electromagnetic decoys stacked over the length of the tube and having upper and lower surfaces, at least one of the upper and lower surfaces of each flat holder being a conical surface, each flat holder being populated between the upper and lower surfaces with a plurality of decoy flakes, at least certain of the flat holders having at least one transverse cut passing through the load of decoys to provide flakes of lengths which vary in accordance with the frequency bands of the electromagnetic waves to be covered by the decoys when launched and scattered in a cloud, a pyrotechnic charge in the lower part of each flat holder to project the holder in the direction of the open end of the tube and to proceed with dispersion of the decoys, each charge being connected to the adjacent charge by a pyrotechnic retarder, the uppermost charge of the stack being provided with at least one pyrotechnic initiator, such that the arrangement formed by the initiator, the charges, and the retarders forms a continuous pyrotechnic chain, in order to allow, after detonating the initiator, the successive ejection of the flat holders in a predetermined time sequence.

2. A cartridge according to claim 1, wherein the conical surface forming the upper or lower surface of each flat holder has its apex directed towards the upper end of the cartridge.

3. A cartridge according to claim 1 wherein each of the upper and lower surfaces of each flat holder is a conical surface, the two corresponding cones formed thereby having the same half-angle at the apex.

4. A cartridge according to claim 3, wherein the half-angle at the apex of each cone is between 80° and 85°.

5. A cartridge according to claim 1, wherein the frequency bands covered by the decoys are between 5 and 40 GHz.

6. A cartridge according to claim 1 wherein the elongated tube and the plurality of flat, decoy-containing holders have a symmetry of revolution with respect to the axis of the tube.

7. A cartridge according to claim 1, wherein an additional pyrotechnic retarder is located between the upper most charge of the stack and the initiator.

8. A cartridge according to claim 1, wherein the length of the delays is between 0.05 and 0.4 seconds.

9. A cartridge according to claim 1, wherein each flat holder comprises an individual envelope containing the decoys, the outer section of which substantially conforms to the inner section of the tube and is closed on its upper face, with the exception of an orifice allowing the transmission of fire, a disc for closing off the lower face provided with a hollow axial extension opening out in the direction of the orifice in the upper face of the envelope and containing the retarder, the disc also being provided with an open cavity able to receive the charge of the flat holder, a closure member for the said cavity comprising an orifice allowing the tranmission of fire.

10. A cartridge according to claim 9, wherein the axial extension of the closing disc passes through the orifice in the upper face of the envelope and on its emergent part comprises a circular groove allowing its engagement in the orifice of the closure member of the adjacent flat holder.

* * * * *